United States Patent [19]

Damson et al.

[11] Patent Number: 4,601,276

[45] Date of Patent: Jul. 22, 1986

[54] METHOD OF AND DEVICE FOR REGULATING FUEL-AND-AIR MIXTURE SUPPLIED TO AN INTERNAL COMBUSTION ENGINE

[75] Inventors: Eckart Damson, Stuttgart; Horst Franke, Löchgau; Helmut Maurer, Vaihingen; Klaus Müller, Tamm; Franz Rieger, Aalen, all of Fed. Rep. of Germany

[73] Assignee: Robert Bosch GmbH, Stuttgart, Fed. Rep. of Germany

[21] Appl. No.: 543,999

[22] Filed: Oct. 20, 1983

[30] Foreign Application Priority Data

Oct. 20, 1982 [DE] Fed. Rep. of Germany ..... 3238753

[51] Int. Cl.[4] ..... F02M 51/00; F02M 7/12

[52] U.S. Cl. ..... 123/489; 123/494

[58] Field of Search ..... 123/169 R, 494, 440, 123/489

[56] References Cited

U.S. PATENT DOCUMENTS

| | | | |
|---|---|---|---|
| 3,895,611 | 7/1975 | Endo et al. | 123/489 X |
| 4,111,171 | 9/1978 | Aono et al. | 123/440 |
| 4,122,811 | 10/1978 | Bowler et al. | 123/440 |
| 4,224,910 | 9/1980 | O'Brien | 123/440 |
| 4,255,789 | 3/1981 | Hartford et al. | 123/417 X |
| 4,266,274 | 5/1981 | Barman | 123/440 X |
| 4,397,278 | 8/1983 | Hughes | 123/440 |

FOREIGN PATENT DOCUMENTS

| | | | |
|---|---|---|---|
| 2056085 | 3/1981 | United Kingdom | 123/169 R |

*Primary Examiner*—Tony M. Argenbright
*Attorney, Agent, or Firm*—Michael J. Striker

[57] ABSTRACT

Disclosed is a method and device for regulating the preparation of fuel-and-air mixture in a carburetor, fuel injection system and the like of an internal combustion engine. The device includes an oxygen probe directly communicating with the combustion chamber of the engine. Periodically fluctuating output signal of the probe is applied to an averaging circuit which produces an average output signal over a predetermined number of engine cycles. The shape and length of the averaged output signal is indicative whether the mixture ratio is lean or rich. The averaging can be made by means of a lowpass filter, an integrator or at least one counter counting in response to the angular position of the crankshaft or the predetermined time intervals. When the probe output voltage has the form of a hump or bulge, its length or area is used for determining the actual λ value in the rich range of ratios of the mixture.

3 Claims, 12 Drawing Figures

FIG. 3a
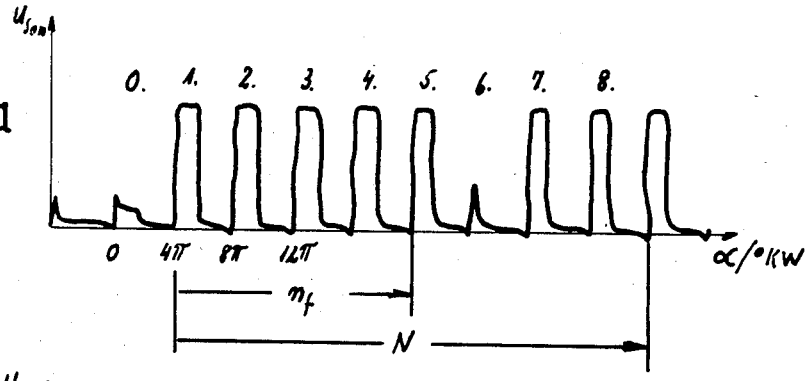
FIG. 3b
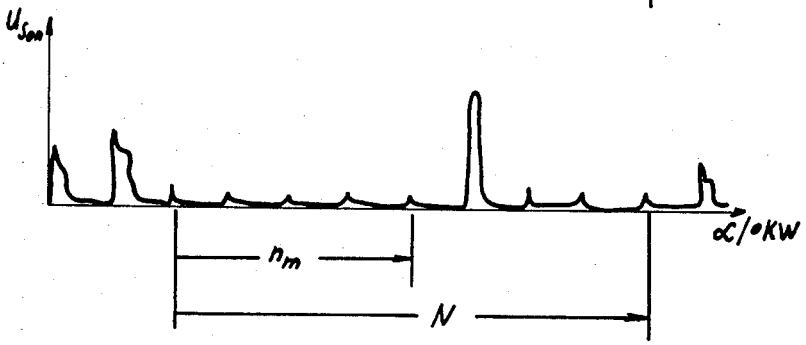
FIG. 4a
FIG. 4b
FIG. 4c
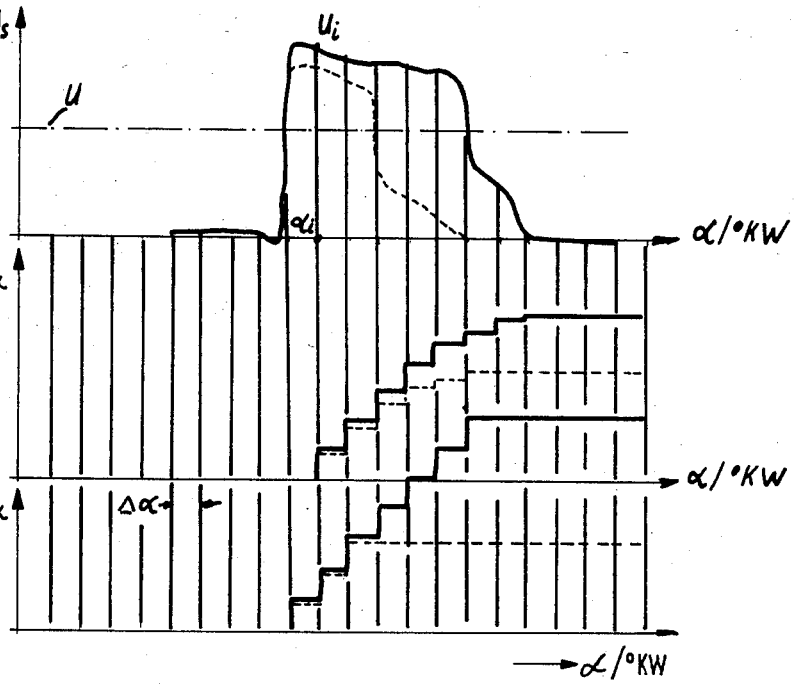

METHOD OF AND DEVICE FOR REGULATING FUEL-AND-AIR MIXTURE SUPPLIED TO AN INTERNAL COMBUSTION ENGINE

BACKGROUND OF THE INVENTION

The present invention relates in general to an internal combustion engine, and in particular to a method of and a device for regulating fuel-and-air mixture supplied to a combustion chamber of an internal combustion engine via a mixture-preparing device having an oxygen probe which is placed directly in the combustion chamber to deliver an output signal indicative of the actual amount of oxygen in the mixture.

In the German patent publication No. 3,028,359 a spark plug provided with an oxygen probe is described to be used in devices which control or regulate feeding of fuel to an internal combustion engine by means of immediate or so-called combustion chamber regulating process. This known spark plug is designed such that an oxygen probe is arranged in the insulator which surrounds the central spark electrode of the plug. The oxygen probe can be made of a number of materials and includes a comparison electrode, a solid electrolyte and a measuring electrode, whereby the comparison electrode and the measuring electrode are connected to a direct-current source to determine partial pressure of oxygen to be compared. Depending on whether at certain time points the partial pressure of oxygen in combustion chamber is interpreted in the sense of too rich or too lean a mixture supplied to the engine, the oxygen probe generates cyclic fluctuations of its output signal which immediately determines the condition in the combustion space.

SUMMARY OF THE INVENTION

A general object of the present invention is to provide a method and device which substantially improve the operation of the above described oxygen probe.

More particularly, it is an object of the invention to provide an improved oxygen probe arrangement which permits, in addition to the immediate measurement of the combustion process, a very fast reaction of the fuel mixture regulating device, even when the so-called "cycle-to-cycle irregularities of fluctuation" interfere with the prompt regulation from one cycle to another one.

Another object of this invention is to provide such an improved oxygen probe arrangement which substantially reduces the detection time of the constituents of fuel-and-air mixture supplied to the IC engine. In comparison with conventional arrangements of oxygen probe in the exhaust pipe, down times resulting from the expulsion of exhaust gases and their passage through the muffler are substantially reduced.

Another object of this invention is to provide such an improved oxygen probe arrangement which operates even under extreme conditions of the fuel-and-air mixture, that is extremely rich or extremely lean, and detects the oxygen ratio after several machine cycles and initiates the corresponding reaction.

In keeping with these objects and others which will become apparent hereafter, one feature of the invention resides, in a method of regulating fuel-and-air mixture supplied to a combustion chamber of an IC engine via a mixture-preparing device including an oxygen probe placed directly in the combustion chamber to deliver an output signal indicative of the actual amount of oxygen in the mixture, in the step of averaging the output signal of the probe from a predetermined number N of engine cycles depending on the rotary speed of the engine. The device for carrying out the novel method includes means for preparing the fuel-and-air mixture and an averaging circuit connected between the oxygen probe and the means for preparing the fuel-and-air mixture to average output signals from the probe over a predetermined number of engine cycles depending on the rotary speed of the engine.

The invention enables monitoring a multi-cylinder engine in average, whereby the measuring results in respective cylinders are evaluated in series according to the ignition sequence. In addition, this invention enables a simultaneous monitoring of each individual cylinder. The latter possibility has the advantage that deviations of the fuel-air mixture composition in the cylinders can be individually removed. In prior-art regulating devices of this kind, it may happen that one engine on average operates at a fuel-and-air mixture value $\lambda=1$ but the individual cylinders, however, may operate with extremely rich and extremely lean mixture. This condition increases fuel consumption and exhaust gas emission, inasmuch as the consumption and exhaust gas characteristics in the range of $\lambda=1$ are not linear. Hence, the monitoring of individual cylinders always produces better overall results when regulating the engine at $\lambda=1$ of mixture value, or at a value which slightly deviates in the direction towards leaner mixtures.

In the preferred embodiments of this invention, the averaging of the oxygen probe output signals over several engine cycles can be made either by means of low-pass filtering circuit, by a time integration of integer cycles, or by time period measurements so as to determine the measure of the excessively rich mixture in the cycles under examination, that is not only a general indication whether the mixture is too rich or too lean. In combining for example the measurement of time intervals with averaging over several cycles, for example over integral multiples of 720° of crankshaft angle, a substantial improvement of regulating possibilities is achieved. The invention enables not only a measurement which is faster then according to conventional methods based on the measurement in the exhaust pipe but also improves the speed of regulation.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

BRIEF DESCRIPTION OF THE DRAWING

FIGS. 3*a* and 3*b* show the plot of cyclic course of probe voltage versus crankshaft angle for rich and lean mixtures, respectively;

FIGS. 4*a*, 4*b* and 4*c* illustrate the evaluation of a single output signal of the probe in the form of a voltage bulge indicative of a rich fuel-air mixture versus angular position of the crankshaft, (FIG. 4*a*), integration of the output voltage bulge in the case of extremely rich mixture and rich mixture (FIG. 4*b*) and the result of computation of richer mixtures (FIG. 4*c*);

DESCRIPTION OF THE PREFERRED EMBODIMENTS

The idea of this invention resides in averaging over a plurality of engine cycles the output signals from a combustion space-λ measuring probe or oxygen probe. These signals, normally subject to strong fluctuations, are now applicable for the regulation of ratio of constituents of a fuel-air mixture of an engine which is faster, more precise and more effective for the preparation of the fuel-and-air mixture and producing an optimum composition of the constituents of the mixture under all operational conditions of the internal combustion engine.

Figure 1:
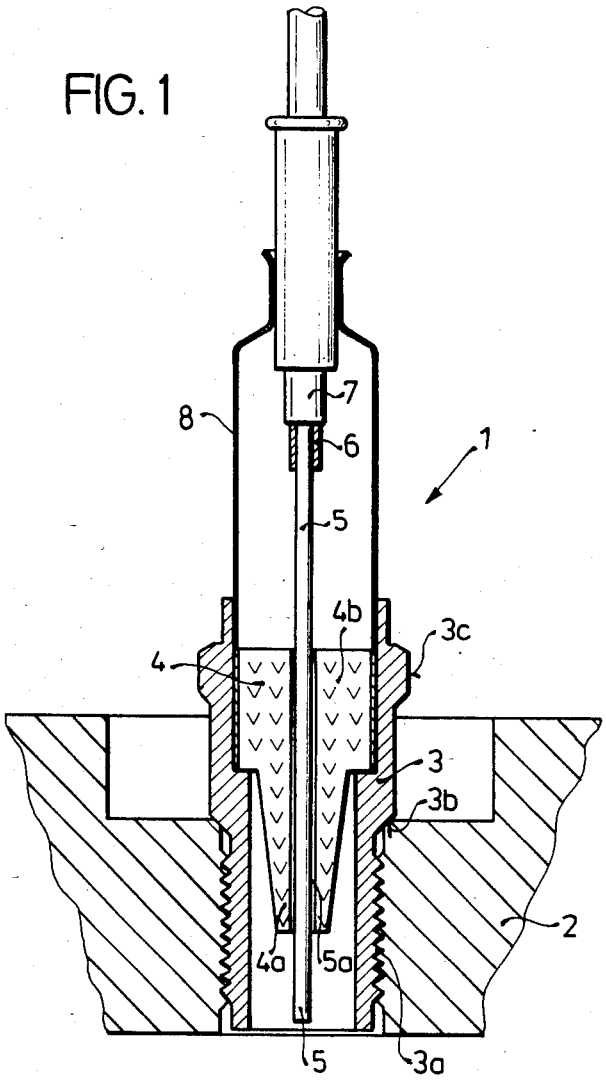
FIG. 1 shows in sectional view a preferred embodiment of a combustion probe or sensor.

Referring firstly to FIG. 1, there is illustrated the construction of a combustion space-λ value measuring probe. Such probes, which have already been devised in a miniature leaf-like form for measuring $\lambda=1$, can be designed in the form of a spark plug socket or can be installed directly in a spark plug and screwed into the wall of the combustion chamber.

In FIG. 1, reference numeral 1 denotes a λ- or oxygen probe which in the following description will be referred to as probe. The probe includes a metal socket 3 provided with an outer thread 3*a*, a sealing seat 3*b*, and a hexagonal nut 3*c*. The threaded socket 3 is screwed in a corresponding threaded hole in wall 2 of a combustion chamber in the IC engine.

Socket 3 supports a cylindrical electrically insulating and pressure-resistant holding body 4 made preferably of ceramic material and having at its end directed to the combustion chamber a projecting nose 4*a*. The holding body 4 is provided with a central axial passage 4*b* preferably of rectangular cross section in which an oxygen-sensing leaf 5 is arranged. The construction of the sensing leaf 5 is known from prior art and will not be discussed in detail. The interspace between the probe leaf 5 and the inner wall of central passage 4*b* acts as a channel 5*a* for reference air. In the example illustrated in FIG. 1, this reference channel 5*a*, which extends throughout the insulating holder 4, communicates with the outer atmosphere so that it can apply outer air to the sensing leaf 5. The probe or sensing leaf 5 can be secured in the ceramic holder 4 either by a suitable putty or by soldering with a glass solder. In the same manner, the ceramic holder can be attached to the metal socket 3 or can be secured in position by a flange joint.

The outer end of sensing leaf 5 is provided with electrical contacts 6 adjoining from opposite sides the leaf 5 and being connected via conductive webs to electrical terminals of a cable 7. A protective tube 8 is secured to the upper rim of the socket 3 and protects the projecting part of sensing leaf 5 and the wires of the cable 7. Due to the direct communication of the lower tip of probe leaf 5 with the combustion space of a cylinder of the engine, the output signal delivered by the probe differs substantially from the output signal of the probe when the latter is installed in the exhaust pipe of the engine, namely when a quasi-homogeneous fuel-air mixture reaches the oxygen probe in the exhaust pipe, then a corresponding probe in the combustion chamber is subject to a mixture which rapidly undergoes changes both in time and in place. During the suction and compression cycle, a fuel-air mixture is present which cannot bring the probe into a balanced condition and is not supposed to do so, inasmuch as the establishment of a balance is bound to an exothermic reaction and could occur only in response to an undesired ignition of the mixture at these time points. Only after ignition and inflammation of the mixture in the combustion chamber is the probe brought into its balanced condition.

The probe needs a certain period of time to detect the ratio of the mixture, and thus it does not respond to the thin flame front when the latter passes by. Under the assumption that the flame front leaves behind a residue of gas with unburned components resulting from the lack of air during the combustion, that is the value λ is less than 1 (rich mixture), then the probe operates as a fuel cell. Oxygen is sucked in through the reference air channel 5*a* and burned in the control path of the probe. In this case the probe generates a measurable voltage in the form of a voltage pulse which due to its relative width is called a voltage bulge. This voltage bulge lasts the longer, the more unburned component particles are present in the residual gas. The duration or length of the voltage bulge can range up to the time point of the exhaust cycle.

Figure 2A:
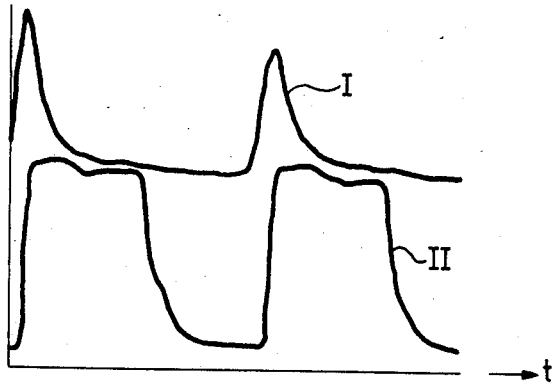
FIGS. 2*a* and 2*b* illustrate plot diagrams of combustion chamber pressures and probe output signals at rich and lean fuel-and-air mixtures, respectively.
Figure 2B:
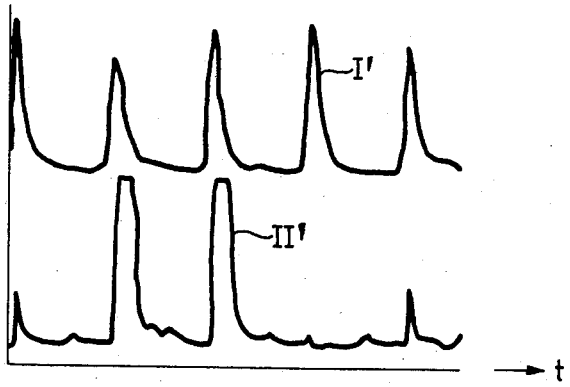

FIGS. 2*a* and 2*b* illustrate time behavior of pressure in the combustion chamber and of the output signal of the probe, based on actual oscillographic measurements. The upper curve I in FIG. 2*a* represents pressure in combustion chamber, and the curve II is the time plot of the output signal from the probe in the case of a rich mixture having its λ value of about 0.9.

In the case of a lean mixture (surplus air in the residual gas), the probe voltage is essentially at a voltage level zero and exhibits only a few short voltage pulses of higher amplitude, the latter pulses occurring statistically due to the mixture preparation and combustion and are called "cycle-to-cycle fluctuations or irregularities". Such fluctuations of the probe output signal are practically unpredictable. According to this invention, the output signals from a combustion space probe, before being evaluated as an actual signal for controlling the composition of the fuel-and-air mixture, are subjected to an averaging process.

The upper curve I′ in FIG. 2*b* shows pressure condition in combustion space and the curve II′ shows the time plot of the output signal from the probe when the fuel-air mixture is leaner or of a value λ of about 1.0.

The averaging of output signals from the probe can be made in different ways, for instance by lowpass filtering, by integration over a time period corresponding to a multiple of integer engine cycles, or by measuring the time period. The aforementioned averaging methods will be discussed in greater detail below.

In interpreting output signals from a combustion space probe by means of lowpass filtering, the output signals of the probe are amplified, then preferably subjected to an impedance adjustment, and then applied to a lowpass filter. The averaged output signal $\overline{U}$ has a relationship to the ratio of the fuel-air mixture λ depicted in FIG. 2c.

Another method of analyzing the output signals of the probe is based on their integration either over a time interval or a predetermined crankshaft angle, and thereupon holding the integrated value in a store. The integration period may be either an integral number of engine cycles or an integral multiple of crankshaft cycles, for example 720° of crankshaft rotation. In the case of time-integration using steady time constants of the integrator, the obtained result must be related to the number of rotations (divided by the number of rotations) because the output signal of the probe is dependent upon the rotary speed of the engine.

In still another embodiment, the output signals of the probe can be interpreted by measuring time periods (real time units or in degrees of crankshaft angle) during which the probe voltage has exceeded a predetermined voltage level. This time measurement necessitates, similarly as in the preceding example, a correction depending on the rotary speed.

Since due to statistical fluctuations in the mixture a "cycle-to-cycle regulation" is inapplicable, the probe voltage is measured over still more cycles before an interpretation of the average condition in the combustion space of the tested cylinder is made.

If the averaging is made over a number of consecutive time intervals or consecutive cycles, then the aforementioned possibilities of time measurement and of integration over a test cycle are applied to a predetermined fixed number of individual engine cylces, and the final result is an average value of the selected number of individual engine cycles. In averaging over consecutive time intervals the actual values evidently occur always at certain time points. Accordingly, in another embodiment of this invention it is of advantage to perform calculation simultaneously with or parallel to the consecutive time intervals. For instance, the averaging process over consecutive or serial time intervals is made twice, whereupon it is reduced to half the number of individual engine cycles under consideration. In this manner it is made possible that fast changes occurring within the fixed number of individual engine cycles are not detected only after the runoff of the selected number of engine cycles, but are detected either immediately or after the runoff of half the number of selected cycles.

In averaging by means of time interval measurements or by integration over the testing cycle, signal values pertaining to individual engine cycles can also be averaged and prepared by the lowpass filtering and digital processing in such a manner that they fled in a shift register of a predetermined length. After each testing cycle, the average value of the individual signal values stored in the shift register is computed. In this way it is achieved that information about actual λ-values is obtained after each individual engine cycle and not only after the runoff of the selected number of such cycles. In addition, in this averaging process by means of lowpass filtering it is also possible to weight the measured values in such a manner that the last stored engine cycle value obtains the largest weight whereas the oldest value stored in the register obtains the least weight. Another preferred method of evaluating and averaging the output signals from an oxygen or combustion space probe is the so-called counting method. In this case there are provided two counters interconnected in such a manner as to count the number of rich cycles following a first rich cycle and the other counter counting the number of lean cycles. After the runoff of a predetermined number of engine cycles, a balance of the two counts is made and the difference or ratio of the two counted values is used for computing the average actual λ-value. For this purpose a calibration curve is prepared which indicates the count state as a function of λ as will be explained in more detail below.

According to still another embodiment of the latter method there is provided a single counter only, which at the beginning of each counting process is set to zero and starts counting either the rich or the lean cycles, inasmuch as the difference relative to a predetermined number of such cycles of necessity corresponds to the number of cycles which have not been counted by the single counter.

This counting method can be with advantage supplemented with secondary conditions. For instance, provided that before the runoff of the total number N of engine cycles a number $n_f$ of consecutive rich cycles ($n_f < N$) occurs and the fuel-and-air mixture has become too rich, and corresponding regulating steps can be immediately performed to correct the mixture ratio. Similarly, in the event that before the runoff of all cycles N, a series of consecutive $n_m$ lean cycles will occur ($n_m < N$), then the mixture is too lean and counteracting regulating measures can be immediately introduced. Such a secondary condition thus takes over the function of a fast monitoring of limit values and offers the possibility to react to deviations before the runoff of the total number N of selected cycles because $n_f$ and $n_m < N$.

Plot diagrams according to FIGS. 3a and 3b show graphically the aforementioned method. Assuming that the total number N of selected cycles equals 8 and $n_f = n_m = 4$, then it is possible already after the half of the predetermined 8 cycles to determine that the mixture is too rich (FIG. 3a) or too lean (FIG. 3b).

From experimentation it has been recognized that particularly in the range of rich mixture values ($\lambda < 1$), the signal voltage hump or bulge is the longer, the richer is the mixture. This finding enables the introduction of an interesting secondary condition or of an additional regulating possibility, in which the intervention the regulating means is not made dependent solely on the averaging of a predetermined number N of engine cycles but is additionally responsive to the determination of the size of the specific voltage bulges. For instance, by suitable circuits the time constant of regulation can be additionally made shorter or longer.

The first-discussed secondary condition, namely the consecutive occurrence of richer or leaner individual cycles differing from the total number N of selected cycles, can be also supplemented with the following secondary condition: Provided that there are $n_f$ rich cycles, then the width of the voltage bulge of the output signal of the probe of the area of this voltage bulge can be determined approximately by computation from time measurements or from integration. The computation result then indicates whether the $n_f$ rich cycles were insufficiently or excessively rich. An example is illustrated in FIG. 4a which depicts such a voltage bulge pertaining to a rich mixture related to the angular position of the crankshaft. The abscissa is divided into sections $\Delta\alpha$ which need not be of the same length. FIG. 4b illustrates an integration $\int U_S d\alpha \approx \Sigma U_i \Delta\alpha$ of the voltage bulge pertaining to a rich mixture. It shows the integration for two different shapes of the voltage bulge, namely for the case, indicated by full lines, of excessively rich mixture and for the case of a normally rich mixture, as indicated by dashed lines. The plot diagram indicated in FIG. 4*c* shows the computation result for the two different shapes of the probe output voltage, indicated as "rich angular sections $\Delta\alpha$".

If one conceives the whole diagram as a continuation of $n_f$ cycles, then the integral value $\Sigma U_i\Delta\alpha$ increases always by an amount illustrated in FIG. 4*b*. The same is valid for the "rich counter state", so that after reaching the number $n_f$ of rich cycles the total value $\Sigma U_i\Delta\alpha$ or $\Sigma\Delta\alpha$ is a measure of the richness of the mixture. From the above examples, it will be recognized that the immediate evaluation of fuel and air mixture in the combustion chamber by a single probe only not only provides information whether the mixture is rich or lean, but also a measure is obtained how rich the mixture has become at a time point of measurement. Such information cannot be obtained from a single probe installed in the exhaust pipe.

Figure 2C:
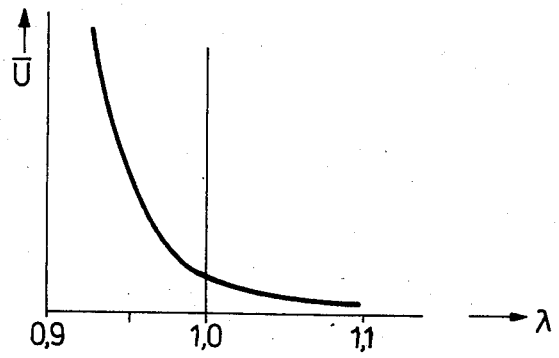
FIG. 2*c* shows a qualitative probe diagram of probe output signals versus the composition of fuel-air mixture as produced by a lowpass filter.
Figure 5:
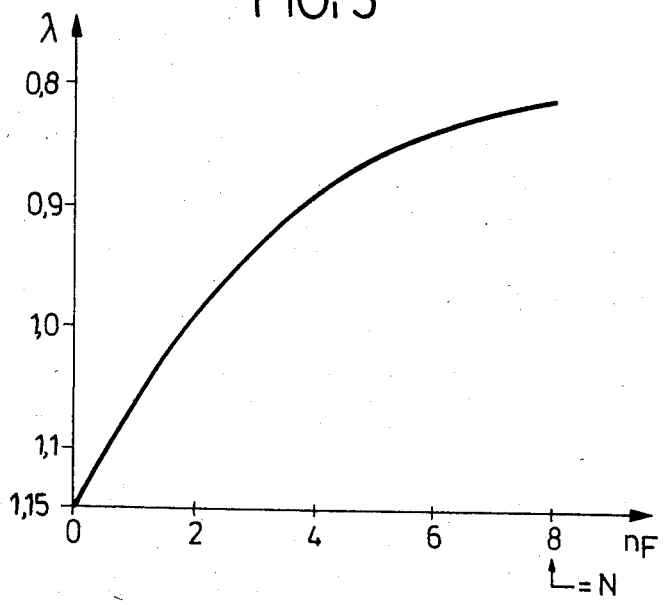
FIG. 5 shows a qualitative plot diagram between a mixture value λ indicative of the ratio of constituents of the mixture and the total number N of engine cycles.

The curve according to FIG. 5, similarly as the curve of FIG. 2*c*, indicates the averaged probe voltage for different $\lambda$ values. The qualitative relationship between and the total number $n_F$ of fat cycles is thus established. The number $n_F$ differs from the number $n_f$ inasmuch as the former may include also interposed lean cycles. At the rich side of the mixture $n_F > n_f$ and in the case of extremely rich mixtures $n_F = N$, that is it corresponds to the total number of selected cycles. On the basis of the aforediscussed various evluation possibilities of output signals from the probe in the combustion chamber, an overall regulating circuit can be constructed utilizing corresponding control of the mixture-preparing device in the engine. Such a regulating circuit is illustrated in a simplified block diagram in FIG. 6. The regulating path includes a mixture-preparing device 10 which in practice can be any fuel dosing device controllable by a feedback signal corresponding to the actual $\lambda$ value, so that at any time point the dosing action and the amount of fuel mixture supplied to the engine are regulated in the desired direction. Such fuel mixture-preparing devices can be electrical, electronic, electromechanical or mechanical fuel-injecting installations which control carburetor or the like fuel-preparing systems for the engine. Reference numeral 11 indicates combustion chamber or an internal combustion engine of several combustion chambers each provided with a separate oxygen probe. In the latter case, each probe has a separate regulating path for its supply of fuel-and-air mixture. Combustion chamber-or oxygen probe 12 delivers a variable output voltage $U_S$ which is to be evaluated in accordance with this invention. In the regulating circuit according to FIG. 6 there are indicated three different evaluation methods, which may be employed either alternatively or in an arbitrary combination with one another so as to achieve the desired regulating operation. The first evaluation process, indicated by A, provides a threshold circuit 13, a counter 14 and converter 18, connected in series to the output of the probe 12. Counter 14 is set to a selected predetermined number N of engine cycles. This predetermined number N is controlled by a sensor 11*a* coupled to engine 11 to feed the counter signals corresponding to individual engine cycles. The branch A of the regulating circuit operates as follows: If the variable probe voltage $U_S$ exceeds a predetermined threshold voltage set by the threshold circuit 13, then a signal corresponding to a rich cycle is applied to the counter 14 which is incremented according to the applied engine cycle signals and after the preset number N of cycles is stopped. The counting result corresponds to the value $N-n_F$, that is in the total number N of engine cycles the residual cycles which have not been counted as rich, are recognized as lean cycles. The converting member 18, adjusted practically according to the characteristic curve of FIG. 5, converts the counting results to the actual $\lambda$ value and applies a corresponding signal to a comparison point 19 in which the actual $\lambda$ value signal is compared with a desired $\lambda$ value signal generated by another threshold circuit or a general desired value generator 19*a*. The resulting regulating deviation is fed via regulator 20 to the control input of the fuel mixture-preparing device 10.

Figure 6:
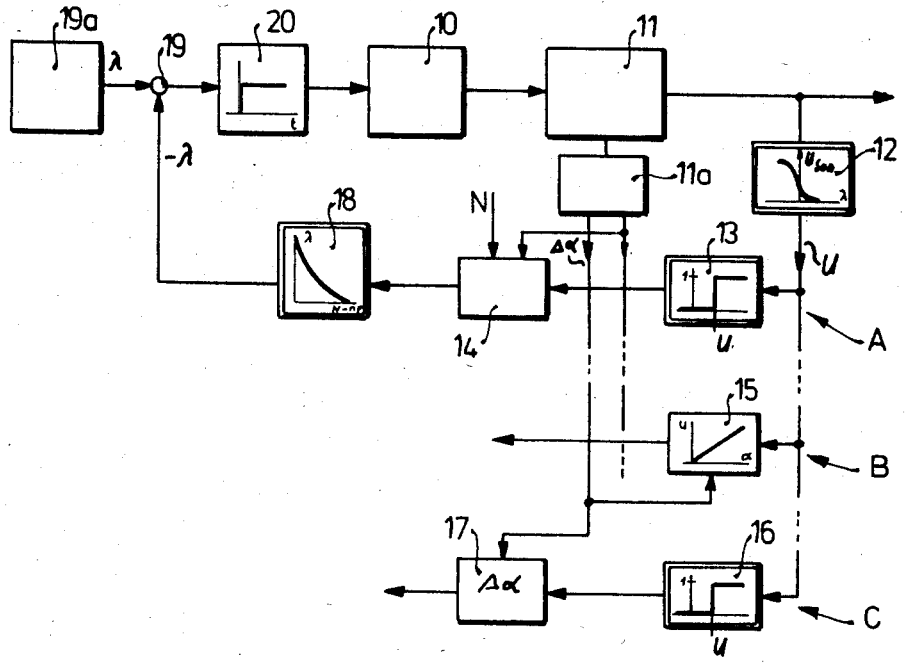
FIG. 6 is a schematic block diagram of one embodiment of a regulating circuit for determining the composition of fuel-and-air mixture in an IC engine by using combustion chamber λ signals produced in accordance with this invention.

An alternative or a supplement to the method A is the method indicated in FIG. 6 by B, in which the probe output voltage is also applied to an integrator 15 where it is integrated in accordance with the plot diagrams of FIGS. 4*a*, 4*b* and 4*c*. In still another alternative or supplement, indicated by C, the output signal $U_S$ is applied to a comparator 16 where it is compared with a predetermined threshold level and if the threshold is exceeded, the signal is counted in angular increments $\Delta\alpha$ in the subsequent counter 17. The $\Delta\alpha$-counter 17 is connected to the generator 11*a* which delivers a $\Delta\alpha$ signal in accordance with the angular position of the crankshaft or camshaft.

Figure 7:
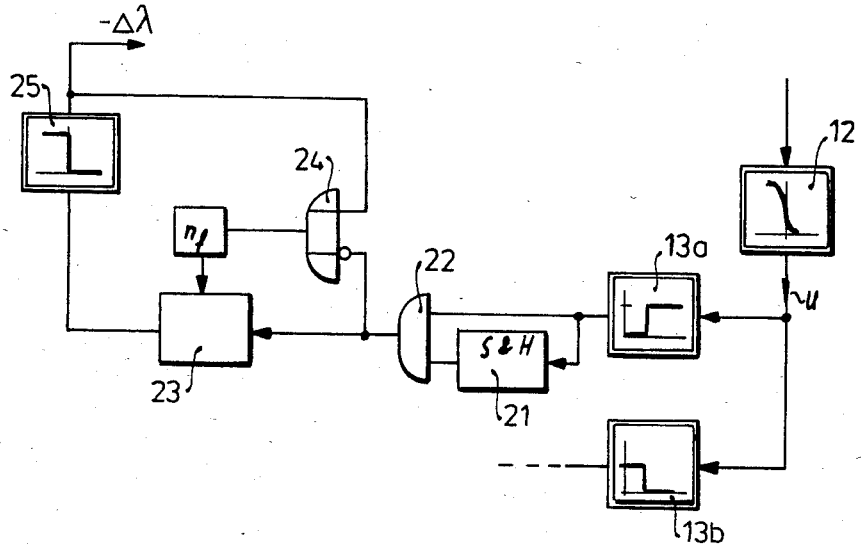
FIG. 7 shows a preferred embodiment of a circuit for λ regulation to measure a rich or lean fuel-air mixture.

The block diagram according to FIG. 7 shows in greater detail a modification of the circuit for evaluation of output signals from the combustion chamber probe to obtain an information about the lean or rich ratio of the fuel-and-air mixture. Output voltage from probe 12 is applied to the subsequent comparators 13*a* and 13*b* set to different threshold levels to determine whether the probe voltage is indicative of lean or rich ratio. The connection of circuit elements at the output of each comparator is identical, so that only one signal circuit, namely for the evaluation of "rich" signals is illustrated in FIG. 7. A storing device 21 operating as a sample-and-hold member is connected between the output of comparator 13*a* for "rich" signals and stores the "rich" signals for the whole period of the testing cycles. The output of the sample-and-hold circuit 21 is connected to one input of an AND-gate 22 whose other input is directly connected to the output of the threshold circuit 13*a*. Accordingly, a logic high or "1" signal appears at the output of the AND-gate 22 when both the preceding and the momentarily measured engine cycles have a rich mixture. In this case, counter 23 is decremented. In the event that the subsequent new cycle has a lean mixture, then a "0" signal is generated at the output of AND-gate 22 and is applied to an inverting input of OR-gate 24. Counter 23 is loaded with a predetermined number $n_f$ (consecutive rich cycles). This loading occurs also in the case when the counter 23 is reset by the signal from the recognition member 25. If the counter 23 is reset in response to the recognition member 25, then this condition is indicative that the consecutive number $n_f$ of cycles must have been reached, and consequently the recognition member 25 immediately generates and applies to the mixture-preparing device a $-\Delta\lambda$ signal to counteract the detected results. As mentioned before, the same circuit operates for the comparator 13*b* adjusted for detecting "lean" signals, only the output signal $+\Delta\lambda$ is generated by the recognition member 25 to introduce an opposite reaction in the mixture-preparing device.

It will be understood that each of the elements described above, or two or more together, may also find a useful application in other types of constructions differing from the types described above.

While the invention has been illustrated and described as embodied in specific examples of fuel-and-air regulating circuits, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method, of regulating fuel-and-air mixture supplied to a combustion chamber of an internal combustion engine via a mixture-preparing device cooperating with an oxygen probe which is placed directly in the combustion chamber to deliver an output signal indicative of the actual amount of oxygen in the mixture, comprising the steps of evaluating the output signals according to their shape denoting either rich or lean ratio mixtures in each cycle, then applying the signals of one kind to at least one counter and after the runoff of a predetermined number $N>1$ of engine cycles, computing the difference between the two kinds of signals and computing the average actual $\lambda$ value, and further comprising the step of determining a new actual $\lambda$ value of the mixture in a cycle, prior to the expiration of the predetermined number N of engine cycles when a predetermined number $n_f$ and $n_m$ of rich or lean consecutive cycles has occurred.

2. A method of regulating fuel-and-air mixture supplied to a combustion chamber of an internal combustion engine via a mixture-preparing device cooperating with an oxygen probe which is placed directly in the combustion chamber to deliver an output signal indicative of the actual amount of oxygen in the mixture, comprising the steps of measuring time intervals of said output signals over a testing cycle corresponding to a predetermined number $N>1$ of engine cycles depending on the rotary speed of the engine, storing the values of said output signals, weighting the stored values in such a manner that the first stored value has a lowest weight whereas the last stored valve has the highest weight, and after each testing cycle averaging the stored values over said predetermined number N of cycles to ascertain an average signal, and regulating the mixture-preparing device by the resulting average signal.

3. A method as defined in claim 2 wherein said output signals are passed through a lowpass filter into a shift register where the values of the filtered output signals are stored.

* * * * *